US007280017B2

(12) United States Patent
Yuze et al.

(10) Patent No.: US 7,280,017 B2
(45) Date of Patent: Oct. 9, 2007

(54) SECURE MAGNETIC SENSOR

(75) Inventors: Kazunori Yuze, Yokohama (JP); Larry Tracy, Auburn, CA (US)

(73) Assignee: Inet Consulting Limited Company, Yokohama (JP)

( * ) Notice: Subject to any disclaimer, the term of this patent is extended or adjusted under 35 U.S.C. 154(b) by 250 days.

(21) Appl. No.: 11/096,438

(22) Filed: Mar. 31, 2005

(65) Prior Publication Data

US 2006/0220770 A1 Oct. 5, 2006

(51) Int. Cl.
*H01H 1/66* (2006.01)

(52) U.S. Cl. ..... 335/151; 335/152; 335/205; 335/206; 335/207

(58) Field of Classification Search ..... 335/151–154, 335/205–207
See application file for complete search history.

(56) References Cited

U.S. PATENT DOCUMENTS 3,945,387 A * 3/1976 Adams ..... 607/31

OTHER PUBLICATIONS

Application Profile 2004A, "High Security Recessed Balanced Magnetic Contacts," (1 pg.), www.flairsecurity.com., no date.

"High Security Contacts Installation Instructions MSS200-7, MSS100-7, MSS100-17," (2 pgs.), www.flairsecurity.com, no date.

Press Release, Jul. 2004, 1 pg., Flair Electronics.

* cited by examiner

*Primary Examiner*—Ramon M. Barrera
(74) *Attorney, Agent, or Firm*—DLA Piper US LLP

(57) ABSTRACT

A secure magnetic sensor has a first magnetic switch activatable by a first magnetic field and a second magnetic switch activatable by a second magnetic field which is stronger than the first magnetic field. The first magnetic switch is electrically connected in series to the second magnetic switch. In the default position, the first magnetic switch is in the open position whereas the second magnetic switch is in the closed position. When the secure magnetic sensor is normally activated, the first magnetic switch is activated to close. However, when the secure magnetic sensor is tampered by the addition of a supplemental magnet, this causes the second magnetic switch to be in an open position thereby sounding an alarm.

2 Claims, 3 Drawing Sheets

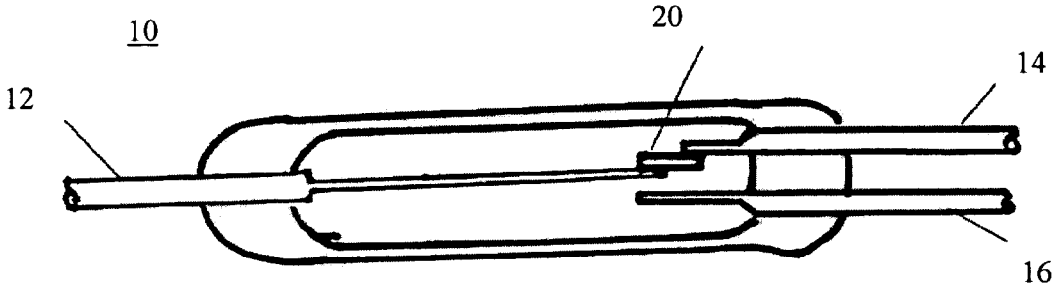
Figure 1(a) – Prior Art
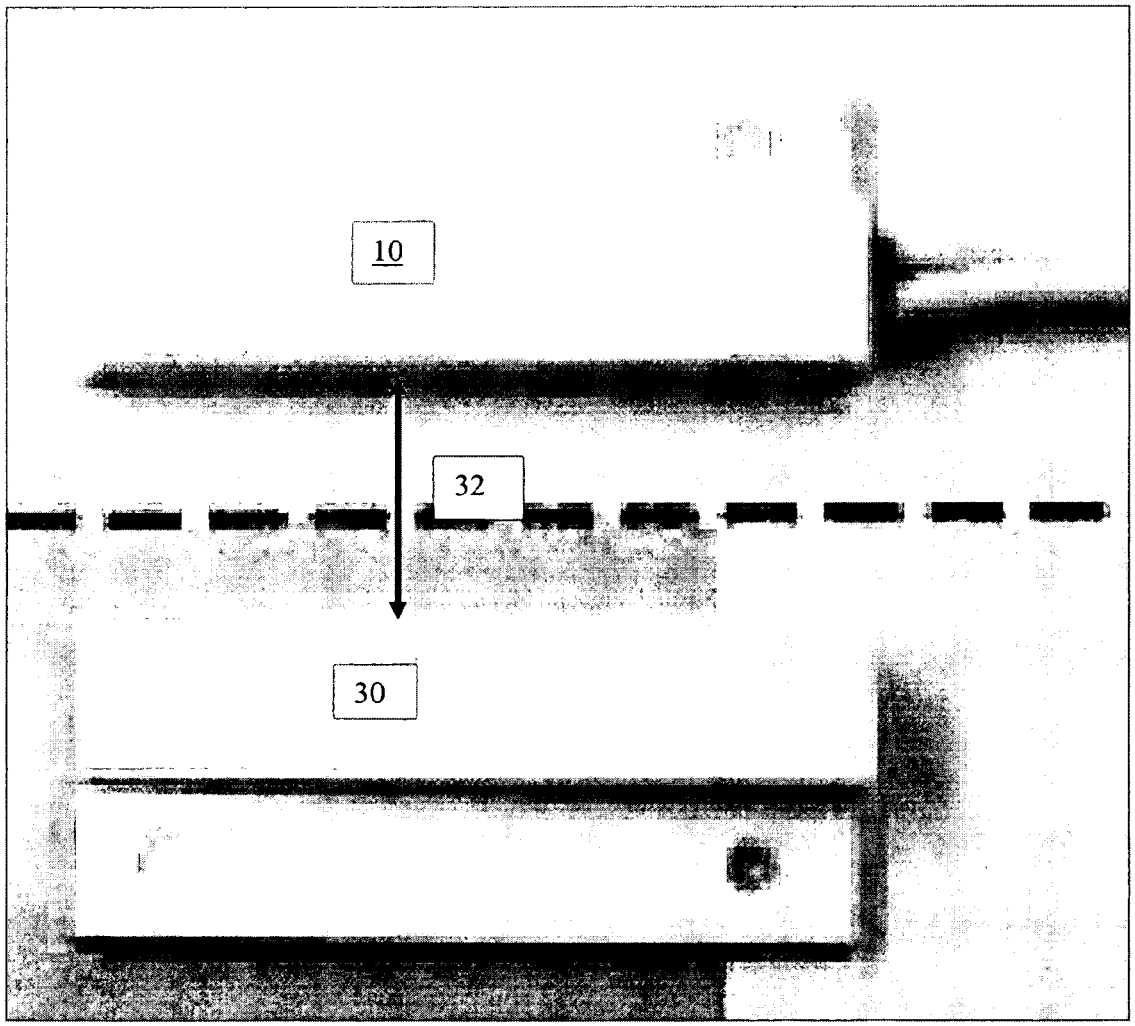
Figure 1(b) – Prior Art

SECURE MAGNETIC SENSOR

TECHNICAL FIELD

The present invention relates to a secure magnetic sensor which is immune to tampering, and more particularly to a secure magnetic sensor which can detect the sensor being tampered.

BACKGROUND OF THE INVENTION

Magnetic sensors are well known in the art. Referring to FIG. 1A there shown a cross sectional view of a magnetic switch 10 or a reed switch 10 of the prior art. The magnetic switch 10 has three terminals: a first terminal 12, a second terminal 14, and third terminal 16. A magnetic attracting member 20 has one end attached to the first terminal 12. The second end of the magnetic attracting member 20 can make electrical contact with either the second terminal 14 or the third terminal 16. In operation, one of the terminals 14 and 16 is a "dummy" terminal, in that it does not have any electrical connection to the external. The other terminal connects to an alarm switch (not shown). Assume for the moment that the second terminal 14 is a "dummy" terminal and that the third terminal 16 is connected to the alarm switch.

In operation, the magnetic switch 10 is typically placed on a door frame with electrical leads connected to the first terminal 12 and the third terminal 16, as shown in FIG. 1B. A magnet 30 is attached to a door. When the door is "closed" the magnet 30 is sufficiently close to attract the magnetic attracting member 20 to pull it to the closed position thereby making electrical contact between the first terminal 12 and the third terminal 16. In this condition, the alarm switch (not shown) is then activated; in that an electrical connection is established sending an electrical signal through the connection of the third terminal 16, through the magnetic attracting member 20, through the first terminal 12. When the door is opened or disturbed, the magnet 30 is moved. When the magnet 30 is moved sufficiently far away, the magnetic attracting member 20 reverts back to its default position which is to make contact between the first terminal 12 and the second terminal 14. In this condition, the circuit between the first terminal 12 and the third terminal 16 is broken. This can then be detected by the alarm panel and an alarm can then be activated.

The magnetic sensor 10 of the prior art can be tampered or otherwise circumvented by a thief or other evil doer. As can be seen in FIG. 1B, there is a gap 32 that exists between the magnet 30 and the sensor 10. Before the magnetic sensor 10 is armed, e.g. during day time, and while the door is open, a thief could place a very thin strip of magnet immediately adjacent to the housing of the magnetic sensor 10. This supplemental magnet, would have sufficient magnetic strength to attract the magnetic attracting member 20 so that it closes the contact to electrically connect the first terminal 12 to the third terminal 16 at a time when the alarm is not activated. When it is desired to arm the magnetic sensor 10, with the door closed, the magnet 30 is moved so that it is adjacent to the magnetic sensor 10. However, since the supplemental magnet is already in contact with the magnetic sensor 10, the presence of the magnet 30 further attracts the magnetic attracting member 20 and continue to close the circuit between the first terminal 12 and the third terminal 16. In this condition, when a thief returns at night time, the thief can overcome the system by moving the door containing the magnet 30 without tripping the alarm. The supplemental magnet resting against the housing of the magnetic sensor 10 would continue to keep the magnetic attracting member 20 engaged in electrical contact between the first terminal 12 and the third terminal 16 thereby preventing the alarm signal from being activated.

Accordingly, there is a need to overcome the deficiencies of the magnetic sensor 10 of the prior art.

SUMMARY OF THE INVENTION

In the present invention a secure magnetic sensor comprises a first magnetic switch and a second magnetic switch. The first magnetic switch is activatable by a first magnetic field. The second magnetic switch is activatable by a second magnetic field which is stronger than the first magnetic field. The first magnetic switch is electrically connected in series to the second magnetic switch.

BRIEF DESCRIPTION DRAWINGS

FIG. 1A is a cross sectional view of a magnetic sensor of the prior art.

FIG. 1B is a top plan view of the location of a magnetic switch of the prior art shown in FIG. 1A together with its associated magnet, in the armed position.

DETAILED DESCRIPTION OF DRAWINGS

Figure 2:
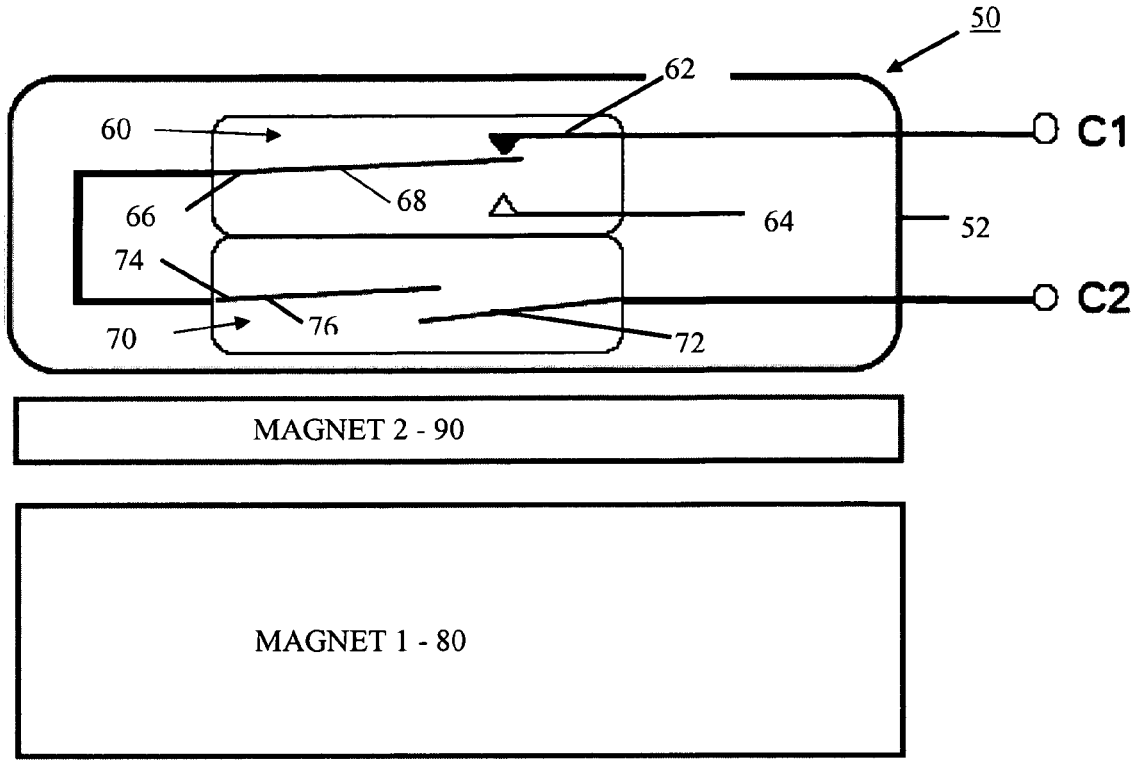
FIG. 2 is a schematic diagram of the secure magnetic switch of the present invention together with its activating magnet and the supplemental magnet that a thief may use to attempt to thwart the security feature of the magnetic sensor of the present invention.

Referring to FIG. 2, there is shown a schematic diagram of a secure magnetic sensor 50 of the present invention. The secure magnetic sensor 50 in the preferred embodiment comprises a housing 52 containing a first magnetic switch 70 and a second magnetic switch 60 positioned adjacent to one another. The first magnetic switch 70 has a first terminal 74 and a second terminal 72. The first magnetic switch 70 also has a first magnetic attracting member 76 having one end which is connected to the first terminal 74 and a second end. In the default position, i.e., the absence of any magnetic field, the second end of the first magnetic attracting member 76 is not connected to the second terminal 72. When a first magnetic field is brought close to the first magnetic switch 70, the first magnetic attracting member 76 is attracted to the magnetic field thereby moving the second end to be in contact with the second terminal 72, thereby closing the electrical connection between the first terminal 74 and the second terminal; 72.

The second magnetic switch 60 also has a first terminal 66, a second terminal 62, and a third terminal 64. The second magnetic switch 60 has a second magnetic attracting member 68 having a first end electrically connected to the first terminal 66. The second end of the second magnetic attracting member 68, in the absence of a second magnetic field, is electrically connected to the second terminal 62. Thus, in the absence of a second magnetic field, or in the default position, the first terminal 66 is electrically connected to the second terminal 62. When a second magnetic field is brought close to the magnetic sensor 50, the second magnetic attracting member 68 is attracted to the magnetic field and the second end thereof is moved to contact the third terminal 64, thereby opening the electrical connection between the first terminal 66 and the second terminal 62. The third terminal 64 is a "dummy" terminal in that it is not connected external to the magnetic sensor 50. The magnetic sensor 50, similar to the magnetic sensor 10 of the prior art, has two external connection terminals C1 and C2. Terminal C1 is connected to the second terminal 62 of the second magnetic switch 60. Terminal C2 is electrically connected to the second terminal 72 of the first magnetic switch 70. The first terminal 74 of the first magnetic switch 70 is electrically connected to the first terminal 66 of the second magnetic switch 60. The first magnetic field which is sufficient to actuate the first magnetic attracting member 76 is a weaker magnetic field than the second magnetic field which is required to move the second magnetic attracting member 68.

The operation of the secure magnetic sensor 50 is a follows. In a default condition, in the absence of any magnetic field, the first magnetic switch 70 is in the open position, and the second magnetic switch 60 is in the closed position. Thus, in the default position, there is no electrical connection between terminal C1 and terminal C2. When a normal magnet 80 such as that attached to a door, is brought close to the secure magnetic sensor 50, the magnetic field generated by the magnet 80 is sufficient only to attract the first magnetic attracting member 76 to close the first magnetic switch 70. In this condition, as can be seen from FIG. 2 an electrical path is completed between first terminal C1 and second terminal 62. In this condition, the premise or the door can be armed and should the door upon which the magnet 80 is mounted is moved, the movement of the magnet 80 would release the first magnetic attracting member 76 returning it to its default or open position. This condition would break the electrical circuit between terminals C1 and C2 which can be detected by the alarm panel and an alarm can be activated.

To thwart a thief or evil doer who attempts to circumvent the security feature of the magnetic sensor 50, by placing a supplemental magnet 90 in the gap 32 between the default magnet 80 and the secured magnetic sensor 50, this condition can be detected as follows.

If the supplemental magnet 90 is placed adjacent to the housing 52 of the secured magnetic sensor 50 during the day time before the premises are armed and secured, when the default magnet 80 is moved into position, e.g. the door is closed and is locked, the presence of both the default magnet 80 and the supplemental magnet 90 creates a larger magnetic field than simply the field generated by the default magnet 80 alone. In this condition, although the first magnetic attracting 76 would continue to be deflected and attracted thereby making contact between the first terminal 74 and the second terminal 72 of the first magnetic switch 70, the combined field of the default magnet 80 and the supplemental magnet 90 is sufficient to attract the second magnetic attracting member 68 to break the contact between the first terminal 66 and the second terminal 62. In this manner, the premise owner, will see that with the door closed the terminal C1 and C2 does not make electrical contact. The premise owner can then investigate to determine the cause of why the alarm panel cannot be armed.

Alternatively, if somehow a thief has made an entrance into the premises and desires to open the door or gate which is protected by the magnetic sensor 50, and attempts to place a supplemental magnet 90 in the gap 32 between the default magnet 80 and the secure magnetic sensor housing 52, the presence of the supplemental 90 would also attract the second magnetic attracting member 68 into the open position thereby breaking the electrical circuit between the terminals C1 and C2, to cause an alarm.

In either of these cases, the addition of a supplemental magnet 90 would either prevent the arming of the alarm, or would actuated the alarm when it is already armed. Thus, the secure magnetic sensor 50 of the present invention is less prone to tampering.

Figure 3A:
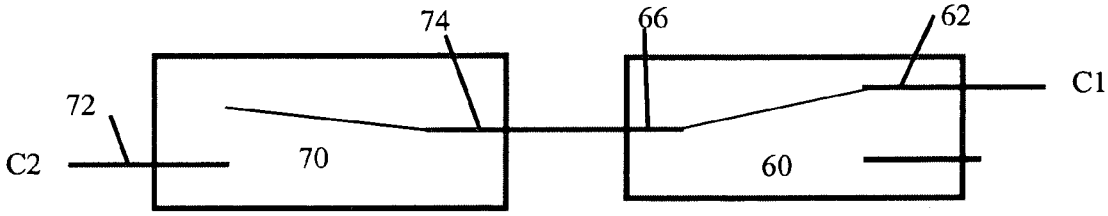
FIG. 3A-3D are electrical schematic diagrams showing other possible electrical connections for the two magnetic switches that are the components of the secure magnetic sensor of the present invention.

Electrically, the operation of the secured magnetic sensor 50 of the present invention may be viewed as two magnetic switches 60 and 70 connected electrically in series with one another, with one of the magnetic switches namely second magnetic switch 60 requiring a greater magnetic field to activate it compared to the first magnetic switch 70. In the preferred embodiment, as can be seen in FIG. 2 and shown in FIG. 3A, the electrical connection of the two magnetic switch 60 and 70 is that the first terminal 74 of the first magnetic switch 70 is electrically connected to the first terminal 66 of the second magnetic switch 60. The terminals C1 and C2 of the magnetic switch 50 are connected with terminal C1 connected to the second terminal 62 of the second magnetic switch 60 and the terminal C2 connected to the second terminal 72 of the first magnetic switch 70. This is shown schematically in FIG. 3A.

Figure 3B:
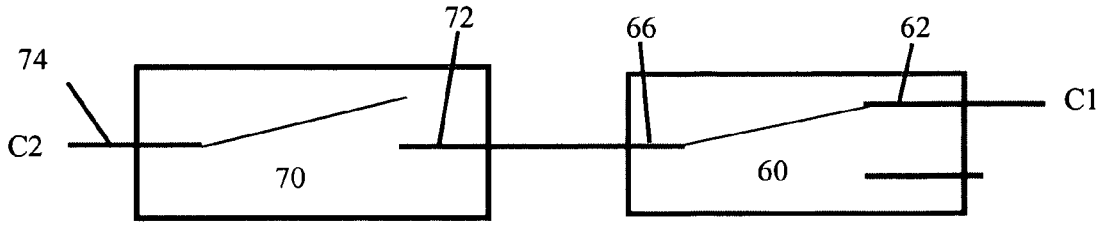

Alternatively, the first terminal 66 of the second magnetic switch 60 can be electrically connected to the second terminal 72 of the first magnetic switch 70 with the terminal C1 connected to the second terminal 62 of the second magnetic switch 60 and terminal C2 connected to the first terminal 74 of the first magnetic switch 70. This is schematically shown in FIG. 3B.

Figure 3C:
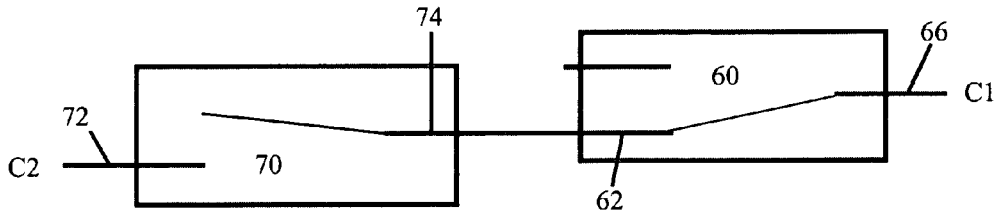

In yet another possible connection, shown in FIG. 3C, the first terminal 74 of the first magnetic switch 70 is electrically connected to the second terminal 62 of the second magnetic switch 60. The terminal C1 of the secure magnetic sensor 50 is connected to the first terminal 66 of the second magnetic switch 60 and the terminal C2 is connected to the second terminal of the first magnetic switch 70.

Figure 3D:
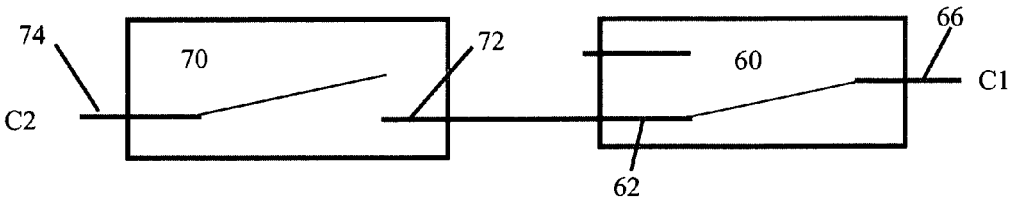

In yet another configuration, shown in FIG. 3D, the second terminal 72 of the first magnetic switch 70 is electrically connected to the second terminal 62 of the second magnetic switch 60. The terminal C1 of the secure magnetic sensor 50 is connected to the first terminal 66 of the second magnetic switch 60 and the terminal C2 is connected to the first terminal 74 of the first magnetic switch 70.

As previously discussed, in the secure magnetic sensor 50 of the present invention, the sensor 50 has two magnetic switches each having a magnetic attracting member whose magnetic sensitivities differ from one another. For the first magnetic sensor 70, the magnetic sensitivity of the magnetic attracting member 76 is dependent upon the size of the gap between the second end of the first magnetic attracting 76 in the default position and the second terminal 72 in the closed position. The distance to which the first attracting member 76 traverses is determinative of the strength of the first magnetic field that is required to activate or attract the first magnetic attracting member 76 to close the switch. As for the magnetic sensitivity of the second magnetic attracting 68, in the default position, it has a bias force urging the second magnetic attracting member 68 to maintain electrical contact between the second end of the second magnetic attracting member 68 and the second terminal 62. This bias force, which is similar to the bias force shown and described for the reed switch 10 of the prior art and shown in FIG. 1A, is determinative of the strength of the second magnetic field which is required to attract the second magnetic attracting member 68 into the open position.

Figure 4:
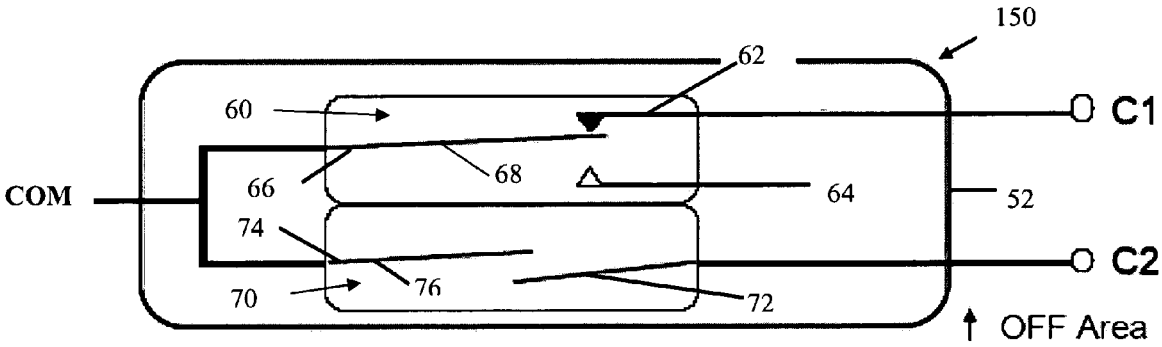
FIG. 4 is a schematic diagram of another embodiment of the secure magnetic switch of the present invention.

Referring to FIG. 4, there is shown a schematic diagram of another embodiment of a secure magnetic sensor 150 of the present invention. The secure magnetic sensor 150 is identical to the secure magnetic sensor 50 shown and described in FIG. 2, except as described hereinafter, and comprises a housing 52 containing a first magnetic switch 70 and a second magnetic switch 60 positioned adjacent to one another. The first magnetic switch 70 has a first terminal 74 and a second terminal 72. The first magnetic switch 70 also has a first magnetic attracting member 76 having one end which is connected to the first terminal 74 and a second end. In the default position, i.e., the absence of any magnetic field, the second end of the first magnetic attracting member 76 is not connected to the second terminal 72. When a first magnetic field is brought close to the first magnetic switch 70, the first magnetic attracting member 76 is attracted to the magnetic field thereby moving the second end to be in contact with the second terminal 72, thereby closing the electrical connection between the first terminal 74 and the second terminal; 72.

The second magnetic switch 60 also has a first terminal 66, a second terminal 62, and a third terminal 64. The second magnetic switch 60 has a second magnetic attracting member 68 having a first end electrically connected to the first terminal 66. The second end of the second magnetic attracting member 68, in the absence of a second magnetic field, is electrically connected to the second terminal 62. Thus, in the absence of a second magnetic field, or in the default position, the first terminal 66 is electrically connected to the second terminal 62. When a second magnetic field is brought close to the magnetic sensor 150, the second magnetic attracting member 68 is attracted to the magnetic field and the second end thereof is moved to contact the third terminal 64, thereby opening the electrical connection between the first terminal 66 and the second terminal 62. The third terminal 64 is a "dummy" terminal in that it is not connected external to the magnetic sensor 150. The magnetic sensor 150, however, has three external connection terminals: C1, C2 and COM. Terminal C1 is connected to the second terminal 62 of the second magnetic switch 60. Terminal C2 is electrically connected to the second terminal 72 of the first magnetic switch 70. The first terminal 74 of the first magnetic switch 70 is electrically connected to the first terminal 66 of the second magnetic switch 60 and is connected to the external terminal COM. The first magnetic field which is sufficient to actuate the first magnetic attracting member 76 is a weaker magnetic field than the second magnetic field which is required to move the second magnetic attracting member 68.

In the operation of the sensor 150, the operation of the terminals C1 and C2 has been described heretofore, with respect to arming the sensor 150 and detecting when a supplemental magnet 90 is present. With the third terminal COM, it is possible to detect when the supplemental magnet 90 is placed in the vicinity of the sensor 150. Thus, the leads COM and C1 can be armed during the day. When the supplemental magnet 90 is placed adjacent to the housing 52, this condition can be detected by the deflection of second magnetic attracting member 68. In this manner, the presence of the supplemental magnet 90 can be immediately detected. Thus, if during the non-armed mode (i.e. day time) when a thief adds the supplemental magnet 90, in the prior art, this condition would not be detected until closing time. At which point, the alarm company is also closing, and it would be difficult for the alarm company to send a technician out to the protected premises to diagnose the problem. In such event, typically, the zone containing the "defective" sensor is by-passed, permitting the intruder to enter the premises at night time. However, with this embodiment, as soon as the supplemental magnet 90 is added, this condition is detected, and a 24 hour monitoring zone is then broken, and a technician can be sent immediately to diagnose the problem. Often, the placement of a supplemental magnet 90 is only one of many acts that a thief or intruder might use to defeat the alarm system.

What is claimed is:

1. A secure magnetic sensor comprising:

a first magnetically activatable sensor having a first magnetically attracting member operable in one of two modes, a first mode wherein said sensor is in an open position, and a second mode wherein in the presence of a first magnetic field, said first magnetically attracting member moves in a first direction to a closed position;

a second magnetically activatable sensor positioned substantially adjacent to said first magnetically activatable sensor in the first direction, said second magnetically activatable sensor having a second magnetically attracting member operable in one of two mode, a first mode wherein said sensor even in the presence of the first magnetic field remains in a closed position, and a second mode wherein in the presence of the first magnetic field and a supplemental magnetic field, said second magnetically attracting member moves substantially in the first direction to an open position; and wherein said first magnetically activatable sensor is electrically connected in series to said first magnetically activatable sensor.

2. The secure magnetic sensor of claim 1 wherein said first magnetically activatable sensor has a first terminal and a second terminal with the first magnetically attracting member having a first end connected to said first terminal, and a second end operable to disconnect the first terminal to the second terminal in the first mode, and to connecting the first terminal to the second terminal in the second mode in the presence of the first magnetic field;

said second magnetically activatable sensor has a first terminal and a second terminal with the second magnetically attracting member having a first end connected to said first terminal, and a second end operable to connect the first terminal to the second terminal in the first mode even in the presence of the first magnetic field, and to disconnect the first terminal to the second terminal in the second mode in the presence of the first magnetic field and a supplemental magnetic field;

wherein the second terminal of the first magnetically activatable sensor is electrically connected to the first terminal of the second magnetically activatable sensor.

* * * * *